US006589069B1

(12) United States Patent
Liao

(10) Patent No.: US 6,589,069 B1
(45) Date of Patent: Jul. 8, 2003

(54) WIRE REEL HAVING A UNIVERSAL SERIAL BUS CONNECTOR CAPABLE OF DOING EMERGENCY CHARGING WORK

(76) Inventor: Sheng Hsin Liao, No. 10, Alley 38, Lane 229, San Chun St., Shulin City, Taipei (TW)

( * ) Notice: Subject to any disclaimer, the term of this patent is extended or adjusted under 35 U.S.C. 154(b) by 0 days.

(21) Appl. No.: 10/126,529

(22) Filed: Apr. 22, 2002

(51) Int. Cl.[7] ..... H01R 13/72

(52) U.S. Cl. ..... 439/501; 439/502; 439/500; 320/114; 320/103; 320/111

(58) Field of Search ..... 320/114, 103, 320/111; 439/502, 505, 638, 76.1, 501, 490, 500

(56) References Cited

U.S. PATENT DOCUMENTS 5,200,685 A * 4/1993 Sakamoto ..... 320/103
5,326,283 A * 7/1994 Chen ..... 439/501
5,720,628 A * 2/1998 Usui et al. ..... 439/501
5,903,135 A * 5/1999 Posses et al. ..... 320/114
5,920,178 A * 7/1999 Robertson, Jr. et al. .... 320/114
5,923,147 A * 7/1999 Martensson ..... 320/111
5,939,860 A * 8/1999 William ..... 320/114
6,127,803 A * 10/2000 Wang et al. ..... 320/114
6,380,714 B1 * 4/2002 Chou ..... 320/114

* cited by examiner

*Primary Examiner*—Gary R Paumen
(74) *Attorney, Agent, or Firm*—Rosenberg, Klein & Lee

(57) ABSTRACT

A portable wire reel capable of doing emergency charging work is provided. The wire reel includes a main body having a chamber therein and a wire slot thereon; a circuit unit disposed in the chamber; a universal serial bus (USB) connector electrically connected with the circuit unit; an input line having one end electrically connected with the circuit unit and the other end connected with a plug, wherein the input line is wound around the main body lengthwise within the wire slot; and a battery connecting base electrically connected with the circuit unit.

9 Claims, 8 Drawing Sheets

WIRE REEL HAVING A UNIVERSAL SERIAL BUS CONNECTOR CAPABLE OF DOING EMERGENCY CHARGING WORK

BACKGROUND OF THE INVENTION

1. Field of the Invention

The present invention relates to a wire reel having a universal serial bus (USB) connector capable of doing emergency charging work. More particularly, the present invention relates to a portable wire reel having a USB connector for charging electric apparatuses. In use, the portable wire reel with a USB connector of this invention may be electrically connected to a notebook or a dry battery for emergency charging portable electric apparatuses such as a mobile phone or a personal digital assistant.

2. Description of the Prior Art

Regular electric wire reels are commonly used to store or automatically take up an electric wire or cable that is typically used to transfer information among electric devices such as computers, modems, telephones, or fax machines.

In prior art, generally disclose reels or containers for receiving coils of wire or rope for paying out the strand and preventing entanglement of the convolutions thereof during the paying out action. These wire reels are generally comprised of a reel body, a casing, a communication wire or cable, a rotary disk, and a spiral power spring. Some improved reel structures having additional positioning function.

As the information technology has been developed, there are many kinds of portable electric apparatuses such as notebooks, cell phones, and personal digital assistant (PDA) are widely used by people in this information age. In use, these portable apparatuses are powered by chargeable batteries such as lithium battery, NiMH battery, Ni—Cd battery. Typically, when the electric power of the batteries is low, these chargeable batteries are charged by using a charger to recover their power. However, the conventional chargers are not user friendly and big in size. Also, one specific charger is often suitable only for one of these kinds of commercial batteries.

Heretofore, none of the prior art discloses a wire reel that incorporates a USB connector and functions as a charger when a portable electric device needs to be charged outdoor or in an emergency situation.

SUMMARY OF THE INVENTION

It is a primary object of the present invention to provide a portable wire reel with a USB connector that is capable of connecting a notebook with a power low electric apparatus for transferring information or charging. It is advantageous to use the present invention since the wire reel according to this invention provides more flexible charging options. Further, the wire reel according to the present is small in size, and therefore it is more convenient to use and carry.

According to the claimed invention, a wire reel having a universal serial bus (USB) connector capable of doing emergency charging work is provided. The wire reel comprises: a main body having a chamber therein and a wire slot thereon; a circuit unit disposed in the chamber; a universal serial bus (USB) connector electrically connected with the circuit unit; an input line having one end electrically connected with the circuit unit and the other end connected with a plug, wherein the input line is wound around the main body lengthwise within the wire slot; and a battery connecting base electrically connected with the circuit unit.

It is to be understood that both the forgoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

FIG. 1 is an exploded diagram of FIG. 1 according to this invention.

DETAILED DESCRIPTION OF THE PREFERRED EMBODIMENT

Figure 7:
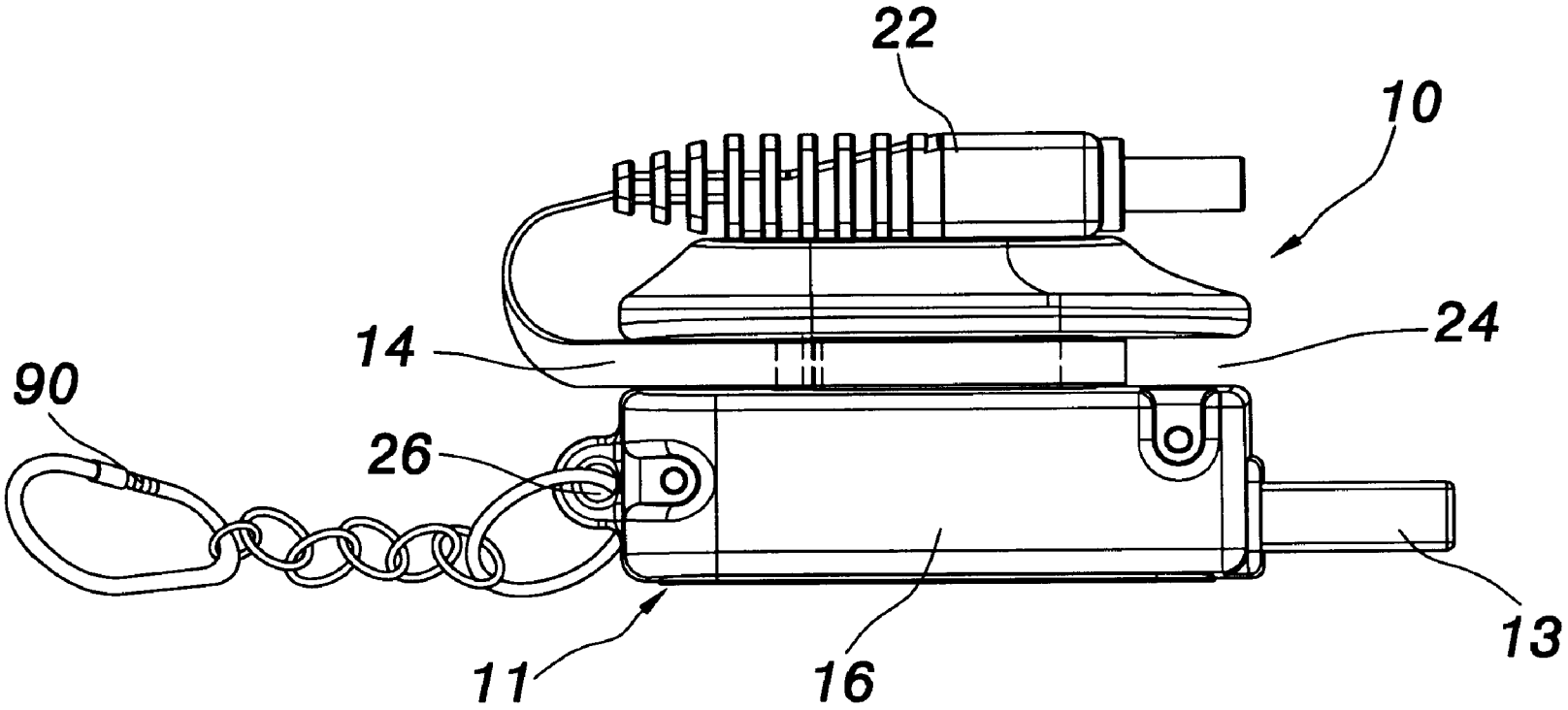
FIG. 7 is a schematic diagram of a second embodiment according to this invention.

Referring to FIG. 1 to FIG. 4 of the preferred embodiment according to the present invention. This invention provides a portable wire reel with a USB connector for charging batteries of various portable electric apparatuses. As shown in FIG. 1 to FIG. 4, wire reel 10 comprises a main body 11, a circuit unit 12, a connector 13, an output line 14, a battery connecting base 15. The main body 11 is a hollow casing consisting of a first half 17 and a second half 18. The first half 17 and second half 18 are assembled by means of a mechanism known in the art such as buckles, screws, or ultrasonic melting process. A chamber 18 is defined by the hollow main body 11 for accommodating the circuit unit 12. As shown in FIG. 7, a hole 26 is provided on the peripheral area of the main body 11. A key ring 90 may pass through the hole 26.

Figure 8:
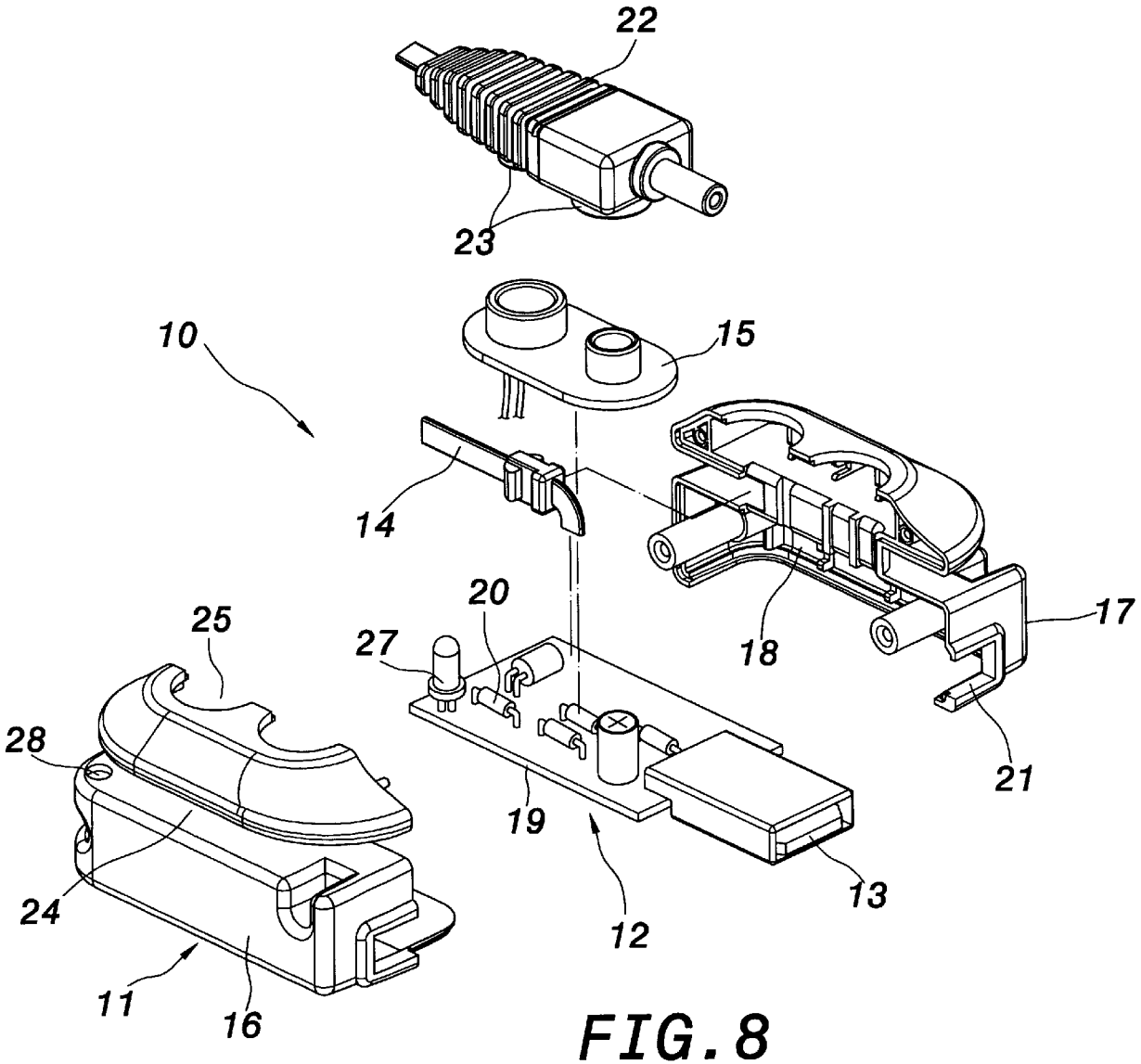
FIG. 8 is an exploded diagram of a third embodiment according to this invention.

The circuit unit 12 comprises a circuit board 19 and a plurality of electric devices 20. The circuit unit 12 is disposed within the chamber 18. In the preferred embodiment of this invention, the connector 13 is a USB connector that is soldered on the circuit board 19. The USB connector is electrically connected with the circuit board 19. As illustrated, one end of the connector 13 protrudes in a first aperture 21 of the main body 11. As shown in FIG. 8, a light source 27 is positioned on the circuit board 19. Preferably, the light source 27 is LED or a light bulb. The light source 27 is used for lighting, displaying, or alarming. A cover portion or hole 28 is located on the main body 11 in a position corresponding to the light source 27.

The input line 14 has one end soldered on the circuit board 19 and is electrically connected with the circuit board 19. The other end of the input line 14 is connected with a plug 22 that is able to connect with a portable electric apparatus such as a mobile phone. A wedging structure 23 is provided on one side of the plug 22 for fixedly engaging with the battery connecting base 15. When the plug 22 is not in use, the plug 22 is fastened on the main body 11 by the interaction between the wedging structure 23 and the battery connecting base 15. Around the main body 11 is an annular wire slot 24. When the input line 14 is drew out form the main body 11, it may be wound around the main body 11 within the wire slot 24, thus preventing entanglement of the excess input line 14.

The battery connecting base 15 is soldered on the circuit board 19 and is electrically connected with the circuit board 19. When assembled, the battery connecting base 15 is extended through a second aperture 25 located on a top face of the main body 11 for electrically connecting with a dry battery (not shown).

Figure 1:
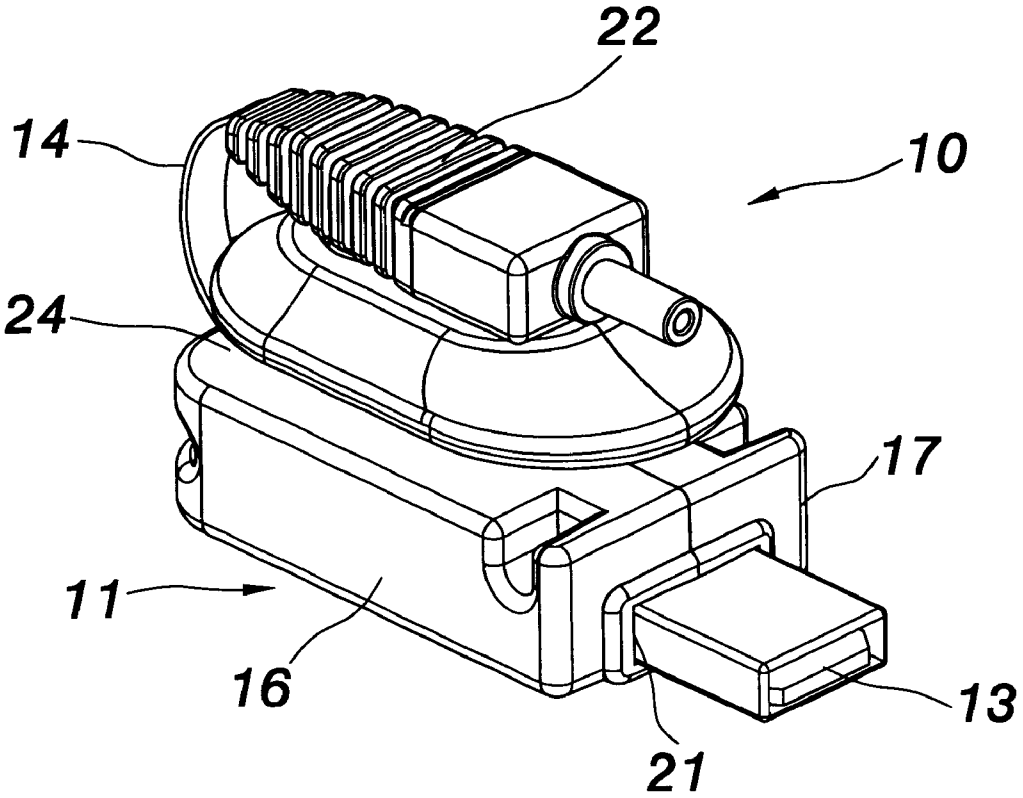
FIG. 1 is a perspective view according to one preferred embodiment of this invention.
Figure 2:
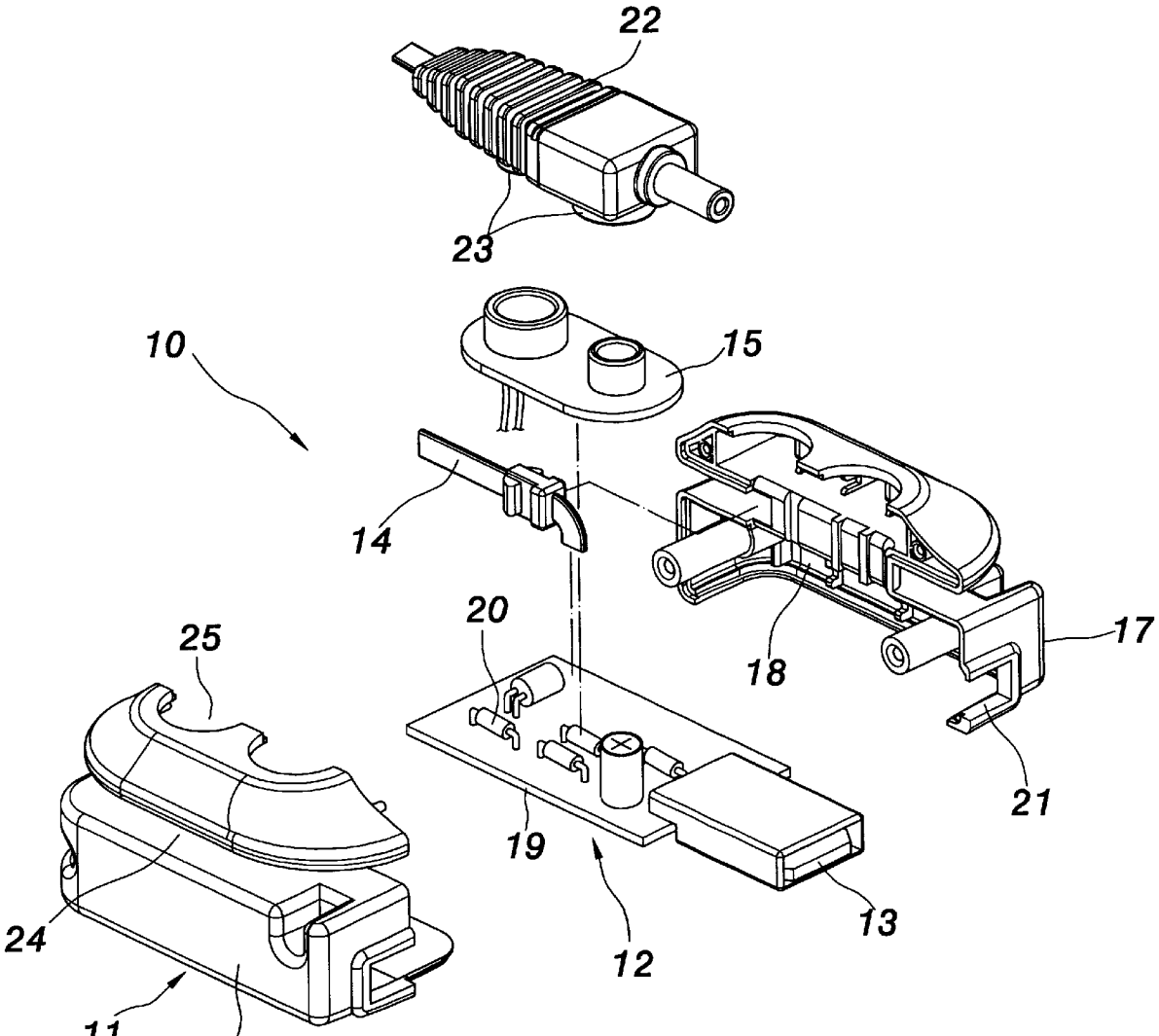
Figure 3:
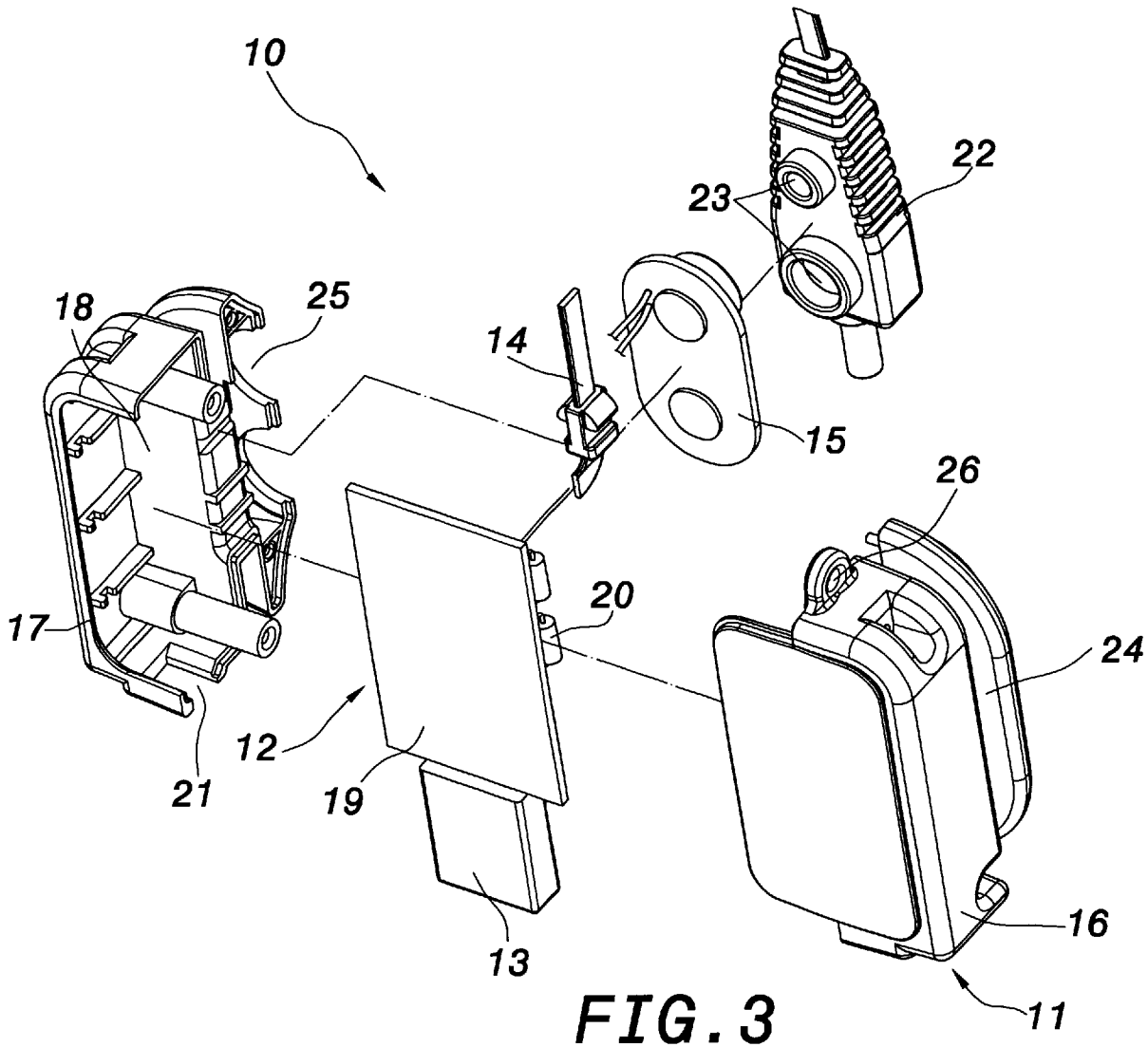
FIG. 3 is an exploded diagram of the preferred embodiment according to the present invention from a bottom view.
Figure 4:
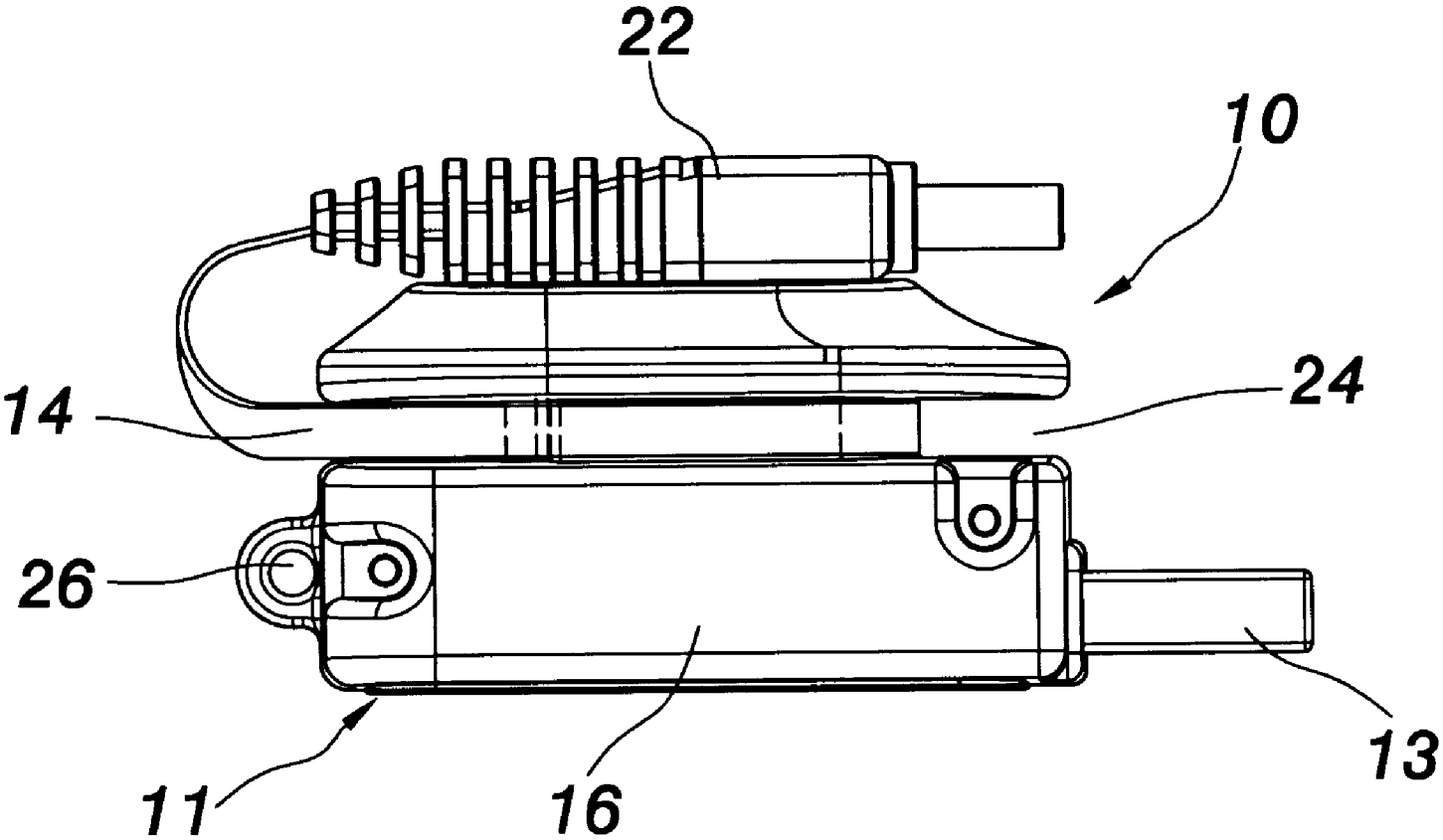
FIG. 4 is a side view illustrating this invention.
Figure 5:
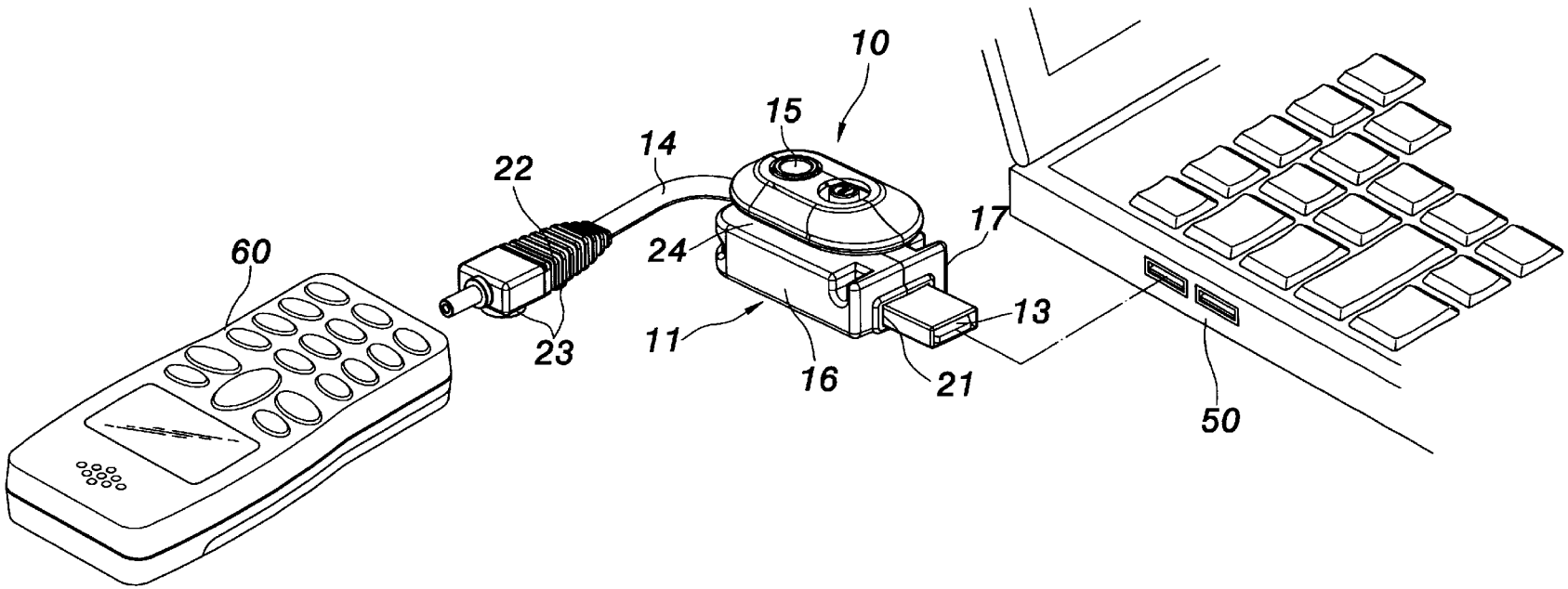
FIG. 5 and FIG. 6 are perspective views illustrating the status of this invention when in use.

Referring to FIG. 5 of a schematic diagram exemplarily showing the use of this invention. In use, the connector 13 is plugged in a DC output terminal of the portable device 50, for example, a notebook. By this way, the connector 13 is electrically connected with the portable device 50 that is capable of providing electric power through the wire reel 10. A portable device 60 to be charged, for example, a cell phone, is plugged by the plug 22 of the input line 14 as indicated. Through this configuration, one can easily charge his/her cell phone or other portable electric devices that is in a low power state by means of a notebook.

Figure 6:
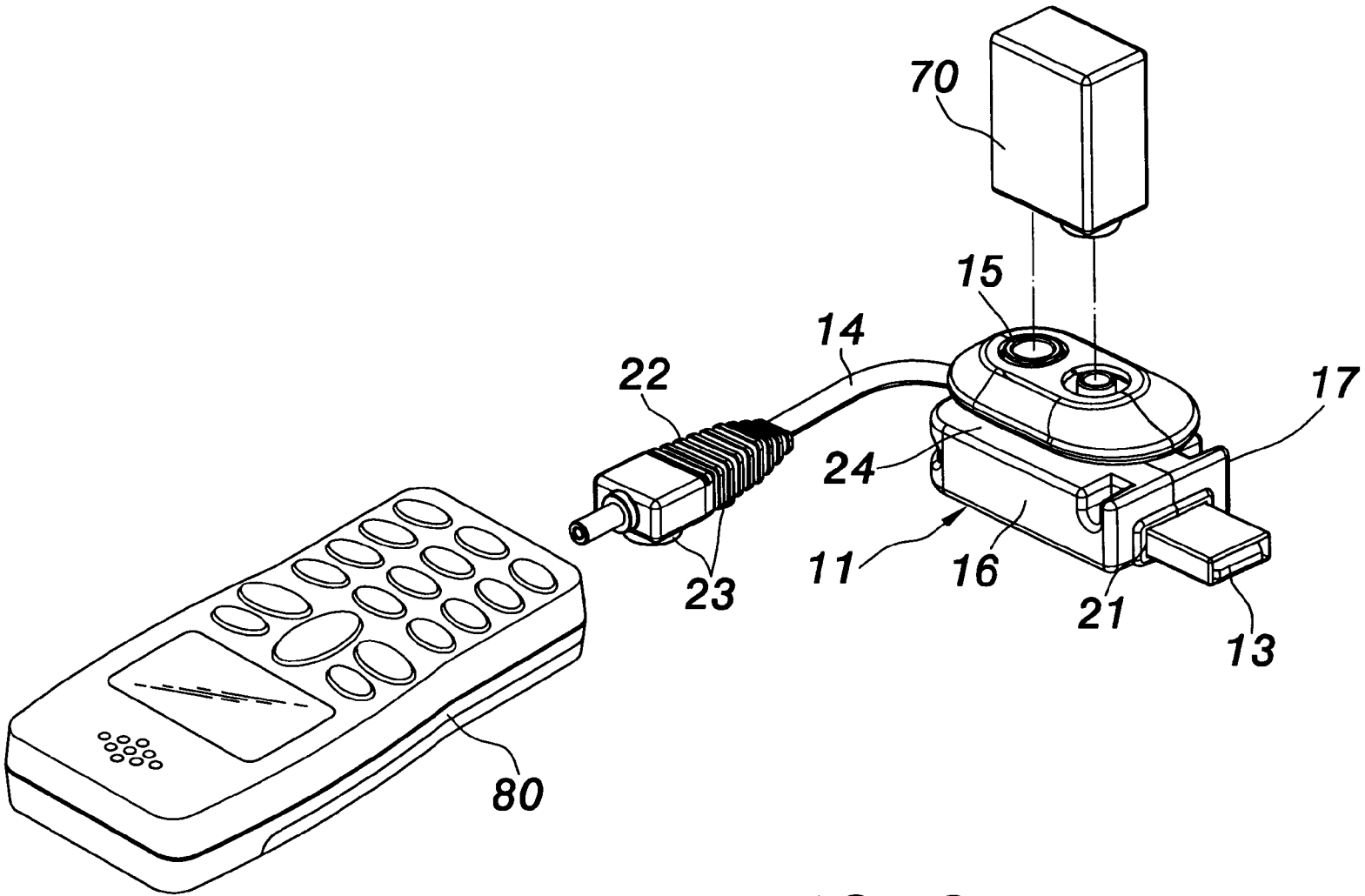

Referring to FIG. 6 of another schematic diagram exemplarily showing the use of this invention. As shown in FIG. 6, the wire reel 10 may be powered by a commercially available dry battery 70. In use, the dry battery 70 is electrically connected with the battery connecting base 15. A portable device 80 to be charged, for example, a cell phone, is plugged by the plug 22 of the input line 14 as indicated. It is convenient for a cell phone user to have this portable wire reel that is capable of charging his or her cell phone by a dry battery.

In short, the present provides a multipurpose wire reel for charging portable apparatuses such as a cell phone. The wire reel according to this invention is also used to transfer information between two electric devices. The cell phone, for example, may be charged by a dry battery or a notebook through the specially designed connectors 13 and 15. Moreover, the wire reel 10 according to this invention is small in size.

Those skilled in the art will readily observe that numerous modification and alterations of the device may be made while retaining the teachings of the invention. Accordingly, the above disclosure should be construed as limited only by the metes and bounds of the appended claims.

What is claimed is:

1. A wire reel having a universal serial bus (USB) connector capable of doing emergency charging work, comprising:

a main body having a chamber therein and a wire slot thereon;

a circuit unit disposed in the chamber;

a universal serial bus (USB) connector electrically connected with the circuit unit;

an input line having one end electrically connected with the circuit unit and the other end connected with a plug, wherein the input line is wound around the main body lengthwise within the wire slot; and a battery connecting base electrically connected with the circuit unit.

2. The wire reel of claim 1 wherein the main body consists of a first half and a second half, and wherein the first half and second half are assembled by means of buckles, screws, or ultrasonic melting process.

3. The wire reel of claim 1 wherein the main body is combined with a key ring through a hole located on periphery of the main body.

4. The wire reel of claim 1 wherein the circuit board comprises a light source and the main body has a light cover or hole corresponding to the light source.

5. The wire reel of claim 1 wherein the USB connector protrudes from the main body.

6. The wire reel of claim 5 wherein the USB connector protrudes from the main body through a first aperture formed on the main body.

7. The wire reel of claim 1 wherein a wedging structure is provided on one side of the plug for engaging with the battery connecting base.

8. The wire reel of claim 1 wherein the battery connecting base protrudes from the main body.

9. The wire reel of claim 1 wherein the battery connecting base protrudes from the main body through a second aperture formed on the main body.

* * * * *